US006742571B2

(12) United States Patent
Yamasaki et al.

(10) Patent No.: US 6,742,571 B2
(45) Date of Patent: Jun. 1, 2004

(54) BUILD-UP MOLD FOR CONTINUOUS CASTING

(75) Inventors: Tsukasa Yamasaki, Buzen (JP); Yasuhiko Kinoshita, Buzen (JP); Takaharu Tagashira, Muroran (JP)

(73) Assignee: Japan Engineering Network Co., Ltd., Fukuoka (JP)

( * ) Notice: Subject to any disclaimer, the term of this patent is extended or adjusted under 35 U.S.C. 154(b) by 0 days.

(21) Appl. No.: 10/087,737

(22) Filed: Mar. 5, 2002

(65) Prior Publication Data

US 2002/0185253 A1 Dec. 12, 2002

(30) Foreign Application Priority Data

May 31, 2001 (JP) ..... 2001-165783

(51) Int. Cl.[7] ..... B22D 11/04; B22D 11/055
(52) U.S. Cl. ..... 164/418; 164/443
(58) Field of Search ..... 164/443, 485, 164/418, 459

(56) References Cited

U.S. PATENT DOCUMENTS 3,866,664 A * 2/1975 Auman et al. ..... 164/443
4,640,337 A * 2/1987 Sevastakis ..... 164/443
5,117,895 A * 6/1992 Hargassner et al. ..... 164/443
5,207,266 A * 5/1993 Nakashima et al. ..... 164/348
5,467,810 A * 11/1995 Grove ..... 164/418
5,771,958 A * 6/1998 Sears, Jr. ..... 164/443
6,145,579 A * 11/2000 Stagge et al. ..... 164/418

FOREIGN PATENT DOCUMENTS

JP 61-209753 * 9/1986 ..... B22D/11/04
JP 2-59144 2/1990
JP 8-52537 2/1996

* cited by examiner

*Primary Examiner*—Kiley Stoner
*Assistant Examiner*—Kevin P. Kerns
(74) *Attorney, Agent, or Firm*—Harness, Dickey & Pierce, P.L.C.

(57) ABSTRACT

A build-up mold for continuous casting has a cooling plate having a plurality of separate and unconnected slit grooves forming cooling channels by a supporting panel attached to the cooling plate using tightening members, wherein the width of the slit grooves next to the tightening members is wider than the width of other slit grooves while depth of all slit grooves are substantially the same.

13 Claims, 5 Drawing Sheets

(a)

(b)

(a)

(b)

(a)

(b)

PRIOR ART

BUILD-UP MOLD FOR CONTINUOUS CASTING

FIELD OF THE INVENTION

The present invention relates to a build-up mold for continuous casting which produces moldings by feeding molten metal such as molten steel, etc., into the upper open portion of a mold, cooling the same from the periphery of the mold via the mold wall, and continuously pulling out solidified molding pieces through the lower portion of the mold.

BACKGROUND OF THE INVENTION

In prior arts, a build-up mold for continuous casting is constructed by making a pair of short-sided molds orthogonal to and between a pair of long-sided molds disposed in parallel to each other and assembling the entirety like boxes.

Respective molds are made of a cooling plate, which is made of copper or the like, and a cooling plate supporting panel (back-up plate) that supports the cooling plate at its backside. The cooling plate supporting panel is connected to the cooling plate, slit grooves are formed on the back side of the casting side of the cooling plate, onto which molten metal is fed, an appointed amount of cooling water is caused to flow into the slit grooves in a state of use, the molten metal that is fed through an opening at the upper portion of the box-shaped mold is cooled down via the cooling plate, and the molten metal is solidified.

Screw holes are provided on the rear side of the copper plate, which becomes a cooling plate, in order to tighten the back-up plate thereon. Therefore, since the cooling grooves are provided apart from the screw holes, the pitch at which the cooling grooves are provided tends to become wider than the original pitch, at which installation is intended, wherein uneven states of cooling resulting therefrom have been solved by some technologies disclosed previously.

However, where molten metal is molded while agitating the same with an electromagnetic force in a mold in order to cast high quality molding pieces, it is requested that the thickness of the copper plate is made thin like 10 mm through 30 mm in order to efficiently transmit the electromagnetic force to the agitation of the molten metal.

Since a depth necessary for the screw holes to tighten the copper plate cannot be secured in such a thin copper plate, a protruding boss portion is provided at the screw portions on the rear side of the copper plate. In the case of the copper plate having boss portions provided thereon, cooling grooves to be installed are located outside the boss portions, and the installation pitch of straight cooling grooves is made excessively wide, wherein the entirety of rows is made into an uneven cooling state, and this may cause the molding pieces to be subjected to cracks due to uneven solidification.

Also, in order to efficiently transmit the electromagnetic force in the copper plate used for electromagnetic agitation, the material of the copper plates may be an alloy having a low electric conductivity. Since the material is low in electric conductivity, the thermal conductivity is also made low, wherein a further uneven cooling structure will occur. Therefore, a structure for making the cooling even is required.

With respect to such build-up molds for continuous casting, for example, the following technologies are disclosed.

(1) Japanese Unexamined Patent Publication No. 1996-52537 (hereinafter called "aa" publication) describes a mold wall for continuous casting, in which the pitches at the opening side of respective slit grooves are made wider at portions that enclose the screwing holes of attaching bolts and holes for attaching a thermocouple, and are made narrower at portions that do not enclose the same, wherein two slit grooves that constitute a wider opening pitch are constructed to be inclined so that they are drawn near each other inwardly from the opening portion toward the groove bottom portion, wherein the pitches between the groove bottom portions of the respective slit grooves are made equal to each other.

(2) Japanese Unexamined Patent Publication No. 1990-59144 (hereinafter called "b" publication) proposes such a type that slit grooves within 100 mm from the vicinity of the molten steel meniscus of the mold wall are disposed so as to bypass at the surrounding of screwing holes of the attaching bolts, wherein the cooling efficiency around the screwing holes is improved. FIG. 5 is a view explaining the disposed state of slit grooves at the surrounding of the tightening members in such prior art build-up molds for continuous casting.

In FIG. 5, 50 denotes a prior art build-up mold for continuous casting, 51 denotes a cooling plate on which slit grooves 52 through 56 which permit cooling water to flow are formed, 57 denotes a cooling plate supporting panel that seals the opening side of the slit grooves 52 through 56 and builds up two sets of cooling plates each having a longer side and a shorter side to be box-shaped, 58 denotes a screwing hole of a bolt or the like that connects and tightens the cooling plate 51 and the cooling plate supporting panel 57 together.

Also, such a cooling structure has also been proposed as a prior art, in which cooling grooves are disposed so as to turn around the boss portions in order to evenly cool down the surroundings of the boss portions provided so as to protrude from the cooling plate.

However, prior art build-up molds for continuous casting have the following problems.

(1) In the build-up mold for continuous casting, which has inwardly inclined slit grooves described in the "aa" publication, it is necessary to repeatedly carry out positioning operations for the respective surroundings of a plurality of screwing holes and attaching holes in order to set a copper plate at an appointed angle by inclining the same when milling or cutting the copper plate, which becomes a cooling plate, by using a milling machine, etc., and a number of steps of machining are required, wherein several problems arise, that is, productivity and manpower saving efficiency are worsened, it is difficult to secure milling or cutting accuracy, a slope in temperature is recognized between the surroundings of the attaching holes and the other portions, and unevenness occurs in the cooling.

(2) Also, in the method for controlling the cooling efficiency at respective positions of the mold wall by adjusting the pitches between slit grooves formed on the cooling plate, it is difficult to uniformly adjust the thermal characteristics such as thermal conductivity over the entire surface of the cooling plate even if the pitches of the slit grooves are merely varied. Therefore, various problems occur. For example, quality of molding pieces may deteriorate due to unevenness in the cooling, and a break-out may occur, by which the solidification shells are broken during continuous casting, and surface coating may be damaged due to a local increase in the temperature of the cooling plate.

(3) In the art disclosed in the "b" publication, which is shown in FIG. 5, the pressure loss of cooling water in slalom type slit grooves 52 and 56 having large bending at the surroundings of the screwing holes 58 is made especially large, and the velocity of the cooling water flowing into these slit grooves 52 and 56 becomes slower than the velocity of cooling water in the slit groove 55 which has a small curvature ratio, is shaped to be nearly straight, and is installed at the middle, wherein a problem arises in that the cooling capacity is lowered, and the cooling is made uneven.

(4) In the method for cooling, in which cooling grooves are provided so as to turn around the boss portions, the mold has such a structure wherein cooling grooves are repeatedly bifurcated and connected together before and after the boss portions. Due to influences brought about by eddies and pressure loss, which are produced by bifurcation and connection, the velocity distribution of the cooling water becomes remarkably complicated, wherein various problems arise in that impurities in the cooling water are likely to be adhered to the bifurcated portions to cause the cooling effect to be spoiled, and simultaneously, analysis of the cooling effects becomes remarkably difficult.

SUMMARY OF THE INVENTION

The present invention solves these and other problems in the above-described prior arts, and it is therefore an object of the invention to provide a build-up mold for continuous casting, which can be produced at low cost by simplifying cumbersome positioning operations when milling or cutting slit grooves on a copper plate that becomes a cooling plate, can make uniform the cooling state on the entire surface of the cooling plate by making the cooling efficiency even over the entire surface of the cooling plate while adjusting the pressure loss and flow amount of cooling water flowing into respective slit grooves, and is capable of improving the yield of molding pieces by preventing a break-out and a casting defect from occurring in continuous casting of molten metal.

In order to solve the above-described object, the present invention has the following construction.

According to the first aspect of the invention, a build-up mold for continuous casting having a cooling plate supporting panel mounted, via tightening members, at the open side of the slit grooves, which become flow passes of cooling water, of the cooling plate in which a number of slit grooves are formed in the casting direction; wherein the widths of the slit grooves disposed so as to bypass in the vicinity of the tightening members is formed to be larger than the widths of the slit grooves disposed in a zone having high cooling efficiency between the tightening members, and the depths of the slit grooves are formed to be roughly equivalent to each other.

Thereby, the following actions can be brought about.

(a) Since, when forming slit grooves on a copper plate which becomes a cooling plate, a build-up mold for continuous casting, which is excellent in cooling efficiency, can be produced by only setting the widths of the slit grooves and adjusting the same, a machining process of the slit grooves such as milling or cutting, etc., can be facilitated, and the mold can be produced at low costs.

(b) Since the pressure loss and flow amount of cooling water flowing into respective slit grooves can be adjusted by the widths of the slit grooves, it is possible to make uniform the cooling efficiency over the entire surface of the cooling plate.

(c) Since the cooling can be evenly carried out, any strain is prevented from occurring in the cooling plate, and since a break-out and a casting defect is prevented from occurring in continuous casting of molten metal, the yield of molding pieces can be improved.

(d) Since the cooling can be uniformly carried out, solidification shells of molding pieces can be made uniform, wherein breakage or cracks of the surfaces of molding pieces due to uneven solidification can be relieved.

(e) Since the cooling efficiency of slit grooves at the side of tightening screws can be improved, the temperature on the cooling wall surface can be lowered. Therefore, the hydraulic pressure needs not to be increased more than necessary, and the amount of cooling water needs not to be increased more than necessary. Uneven cooling that occurs by radical changes in the thermal transmission due to a boiling phenomenon on the wall surface can be prevented from occurring.

(f) Since the temperature of the mold is made uniform, treated portions of the surface such as plating coated thereon can be prevented from cracks due to local heat application, and the service life in use can be extended.

(g) Where the cooling plate is constructed of a metallic material of high thermal conductivity including copper or its alloy, the thermal conductivity of the entire cooling plate can be increased, and the cooling can be efficiently performed.

(h) Since the slit grooves can be simply machined by milling the metallic material of high thermal conductivity, no process of installing a milling machine in an inclined state is any longer required, wherein labor can be saved, and the production costs thereof can be relieved.

Herein, the cooling plate is rectangular, whose lateral width is 100 through 3000 mm, and the height, that is, the length in the casting direction is 700 mm through 1500 mm. As the material, a metal material including copper having large thermal conductivity, for which a milling process can be facilitated when forming slit grooves may be preferable.

The slit grooves may be shaped so that their section is rectangular, the entirety may be rectangular while its corner at the groove bottom portion is cut off to be made round, and the slit grooves may be easily machined by a milling machine, etc.

The spacing between the bottom portion of the slit grooves and the surface of the cooling plate with which molten metal or solidified molding pieces are brought into contact is made equivalent to one-fourth through three-fourths of the thickness of the cooling plate. That is, it is preferable that the depth of the slit grooves is in a range from three-fourths through one-fourth with respect to the thickness of the cooling plate. If the depth of the slit grooves is shallower than one-fourth, the area of the cooling surface, which is formed in the cooling plate body, is made short, thereby making efficient cooling difficult. To the contrary, since the strength of the entire cooling plate is made short if the depth is deeper than three-fourths, this is not preferable.

Also, the widths of the slit grooves, that is, the widths of the openings is set in a range from one-fifteenth through one-third with respect to the thickness of the cooling plate. If the width of the slit groove is smaller than one-fifteenth, the pressure loss of cooling water supplied is increased, wherein the cooling efficiency is remarkably worsened. To the contrary, if the width is larger than one-third, this is not preferable since the spacing is decreased, in which a plurality of slit grooves are adequately disposed so that the entirety of the cooling plate is uniformly cooled in consideration of thermal characteristics and flow quantity characteristics between the slit grooves.

The cooling plate supporting panel is made of stainless steel or steel having large rigidity and strength, and is shaped rectangular so that it can cover the entirety of the cooling plate. The cooling plate supporting panel seals the openings of the slit grooves and forms flow passes of cooling water, and simultaneously rectangularly assembles a pair of cooling plates, each of which constitutes a long side and a short side of a mold and further functions so as to support the entirety of the mold.

The tightening members correspond to screw holes that are formed at appointed positions of a cooling plate to cause bolts to be screwed therein, attaching portions including boss portions around the screw holes, and other pin holes, etc., and further includes insertion holes of thermocouples for measuring the temperature thereof, which are provided at a mold wall consisting of a cooling plate.

Since the tightening members and their neighborhood on the cooling plate cannot be directly cooled down by causing cooling water to flow thereat, the cooling efficiency may be worsened. Areas that are directly cooled down with cooling water, like intermediate portions of the adjacent tightening members, are regarded as sections having high cooling efficiency.

In the build-up mold for continuous casting according to the second aspect of the invention, the ratio (a/b) of the maximum value (a) of the widths of the respective slit grooves in the cooling plate to the minimum value (b) thereof is between 1.1 and 4 in addition to the first aspect.

Thereby, the following actions can be obtained in addition to the actions brought about by the first aspect.

(a) Since the range of adjustment of widths of the slit grooves is set to an appointed range, cooling at the cooling plate can be made uniform, and cooling efficiency thereof is improved, and it is possible to further efficiently prevent molding defects and break-out from occurring in continuous casting, wherein the yield can be further improved.

If the ratio (a/b) between the maximum value (a) of the slit grooves and minimum value (b) thereof is smaller than 1.1, the range of adjustment of the width between the slit grooves is too narrow, wherein it becomes difficult to adequately dispose the slit grooves so that the cooling plate can be sufficiently uniformly cooled. To the contrary, if the ratio (a/b) exceeds 4, remarkable differences arise between the flow quantities of cooling water flowing into the respective slit grooves, whereby problems arise in that strain and/or framework mismatching may occur in the entirety of the cooling plate due to differences in thermal expansion at respective positions of the cooling plate. This is not preferable.

The build-up mold for continuous casting according to the third aspect is constructed, in addition to the first and second aspects, so that a pattern of the slit grooves disposed on the cooling plate is formed to be roughly symmetrical at the left and right sides with respect to the centerline in the casting direction.

Therefore, the following actions can be brought about in addition to the actions described in the first and second aspects.

(a) Since the patterns of the slit grooves are formed roughly symmetrical at the left and right sides thereof, data input can be further facilitated when controlling a milling machine using NC (numerical control), wherein the slit grooves can be easily formed.

(b) Since the patterns of the slit grooves are symmetrical at the left and right sides, the entirety of the cooling plate can be further efficiently cooled down, matching a thermal flow from the cooling plate that will inherently become symmetrical at the left and right sides thereof.

The build-up mold for continuous casting according to the fourth aspect of the invention is constructed, in addition to any one of the first aspect through the third aspect, so that the slit grooves disposed on the cooling plate are of a slalom type that is formed so as to have a plurality of portions having an appointed curvature, and the widths of slit grooves having a large curvature is formed to be larger than the widths of slit grooves having a small curvature.

Therefore, the following actions can be brought about in addition to the actions described in any one of the first aspect through the third aspect.

(a) Since resistance of the flow passes of cooling water flowing into slit grooves having a large curvature is greater than that of the flow passes of cooling water flowing in slit grooves having a small curvature, the widths of the slit grooves are adjusted in line therewith, wherein resistance of the flow passes of cooling water per slit groove can be made uniform, and the cooling plate can be further adequately cooled down.

(b) In a case where all slit grooves are designed so as to have the same width, the pressure loss at portions of slit grooves having large slalom bending around the tightening members will be made large, and the velocity of cooling water flowing into the slit grooves is made slower than the velocity of cooling water flowing into straight slit grooves having no curvature, which are disposed at the middle portion, wherein the cooling capacity is lowered. Therefore, if the width of a slit groove is made wide at portions having a large curvature, and is made narrow at portions having a slight curvature, the pressure loss of cooling water flowing water passes can be made uniform. Resultantly, the velocity of cooling water flowing into respective slit grooves can be averaged. Thus, a lowering of the cooling capacity, which is caused by slowing of the velocity of cooling water flowing into slalom type slit grooves secured to strengthen the cooling around the bosses of tightening members, can be improved by varying the widths of the slit grooves.

The build-up mold for continuous casting according to the fifth aspect of the invention is constructed, in addition to any one of the first aspect through the fourth aspect, so that the respective slit grooves of the cooling plate are formed so as to have an appointed width, and velocity and/or pressure loss of cooling water that is provided into the slit grooves at an appointed pressure level are made roughly equivalent.

Therefore, the following actions can be brought about in addition to the actions described in any one of the first aspect through the fourth aspect.

(a) Since the velocity and/or pressure loss of cooling water flowing through respective slit grooves are made roughly equivalent, using cooling water which is not much as a whole, the build-up mold for continuous casting can be maintained at a cooled state where a uniform temperature distribution can be obtained.

With a build-up mold for continuous casting according to the first aspect, the following effects can be brought about.

(a) By only setting and adjusting the widths of slit grooves when forming the slit grooves in a copper plate that becomes a cooling plate, a build-up mold for continuous casting, which has an excellent cooling efficiency, can be produced, wherein the machining process of slit grooves such as milling or cutting can be facilitated, and the production costs can be reduced.

(b) The pressure loss and flow quantity of cooling water streaming in respective slit grooves can be adjusted by the widths of the slit grooves, and the cooling efficiency over the entire cooling plate can be made uniform.

(c) Since the cooling can be evenly carried out, no strain is permitted to arise in the cooling plate, and break-out and defects of molded pieces are prevented from occurring in continuous casting of molten metal, wherein the yield of molded pieces can be improved.

(d) Since the cooling can be evenly carried out, solidification shells of molded pieces can be made uniform, and it is possible to relieve generation of surface cracks of the molded pieces, which result from uneven solidification.

(e) Since the cooling efficiency of the slit grooves at the side of the tightening screws can be improved, the temperature of the cooling wall surface can be lowered. There becomes no case where the water pressure is raised more than necessary or the quantity of cooling water is increased more than necessary, wherein it becomes possible to prevent uneven cooling due to a radical change in the thermal transmission resulting from a boiling phenomenon on the wall surface.

(f) Since the temperature of a mold is made uniform, cracks, etc., due to local heat are prevented from occurring on surface-treated portions such as plated portions, which are coated on the surface, wherein it is possible to make the service life longer.

(g) Where the cooling plate is constructed of a high thermal conductivity metallic material including copper or its alloy, the thermal conductivity of the entire cooling plate can be increased, and cooling can be efficiently carried out.

(h) Since slit grooves can be simply formed by milling the high thermal conductivity metallic material, no process is required, in which a milling machine is inclined and set, wherein labor can be saved, and production costs can be decreased.

With the build-up mold for continuous casting according to the second aspect, the following effects can be brought about in addition to the effects in the first aspect.

(a) Since the widths of slit grooves are adjusted in an appointed range, uniformity in cooling by the cooling plate and improvement in the cooling efficiency thereof can be achieved, defects of molded pieces and break-out can be further efficiently prevented from occurring in continuous casting, wherein the yield can be improved.

With the build-up mold for continuous casting according to the third aspect, the following effects can be brought about in addition to the effects described with reference to the first or second aspect.

(a) Since the patterns of slit grooves are formed to be roughly symmetrical at the left and right sides thereof, data input can be facilitated when controlling a milling machine using numerical control equipment, etc., and it becomes possible to easily form the slit grooves.

(b) Since the pattern of slit grooves is symmetrical at the left and right sides, the entirety of the cooling plate can be further efficiently cooled down, matching the heat flow from the cooling plate that inherently becomes symmetrical at the left and right sides.

With the build-up mold for continuous casting according to the fourth aspect, the following effects can be brought about in addition to the effects described with reference to any one of the first aspect through the third aspect. That is, (a) Since the resistance of a flow pass of cooling water flowing into slit grooves having a large curvature is greater than that of the flow passes of cooling water flowing into slit grooves having a small curvature, the widths of the slit grooves are adjusted corresponding thereto, and the cooling plate can be further adequately cooled by making uniform the resistance in flow passes of cooling water in the respective slit grooves.

(b) Where all slit grooves are designed with the same width, a pressure loss is increased at the slit groove portions having a large curvature at the curved portions around the tightening members, and the velocity of cooling water flowing into the slit grooves is made slower than the velocity of cooling water flowing into straight slit grooves free from curvature, which are disposed at the middle, wherein the cooling capacity is lowered. Therefore, the widths of slalom type slit grooves are widened at a portion having a large curvature and is narrowed at a portion having a slight curvature, whereby the pressure loss of cooling water flowing into the slit grooves is made uniform. As a result, the velocity of cooling water flowing into the respective slit grooves can be made even. Thus, a lowering of the cooling capacity, which is caused by a slowing of the velocity of cooling water flowing into the slalom type slit grooves provided to strengthen the cooling around the bosses of the tightening members can be improved by varying the widths of the slit grooves.

With the build-up mold for continuous casting according to the fifth aspect, the following effect can be brought about in addition to the effects in any one of the first aspect through the fourth aspect.

(a) Since the velocity and/or pressure loss of cooling water flowing into respective slit grooves are made roughly equal to each other, the build-up mold for continuous casting can be cooled down in a comparatively strain-free state, using a small amount of cooling water as a whole.

BRIEF DESCRIPTION OF THE DRAWINGS

FIG. 2(*b*) is a detailed plan view thereof;

EMBODIMENTS OF THE INVENTION

Hereinafter, a description is given of an embodiment of the invention with the accompanying drawings.

Figure 1:
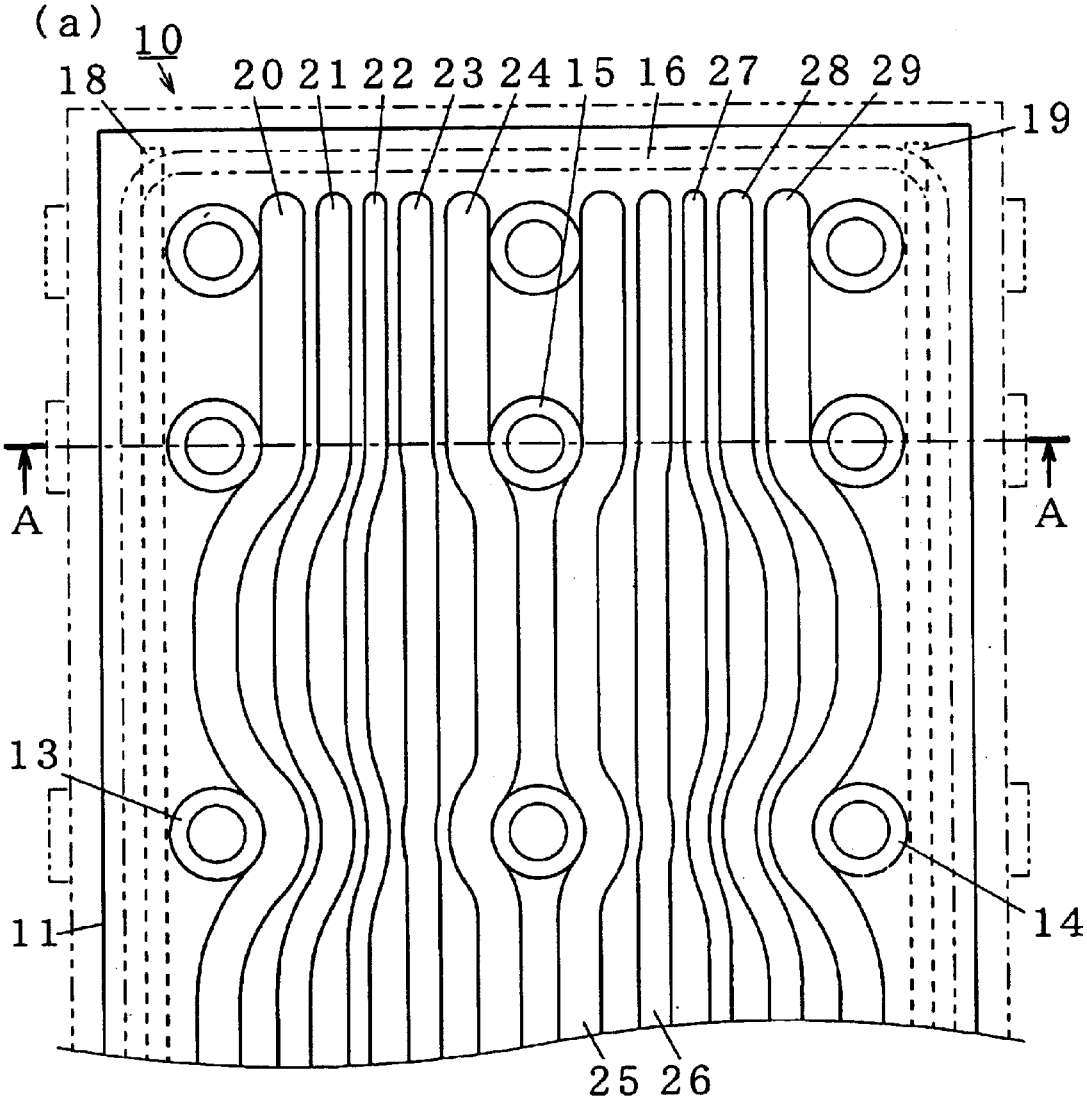
FIG. 1(*a*) is a front elevational view of a cooling plate of a build-up mold for continuous casting according to the embodiment, and FIG. 1(*b*) is a view explaining a cross-section of the same cooling plate.
Figure 1:
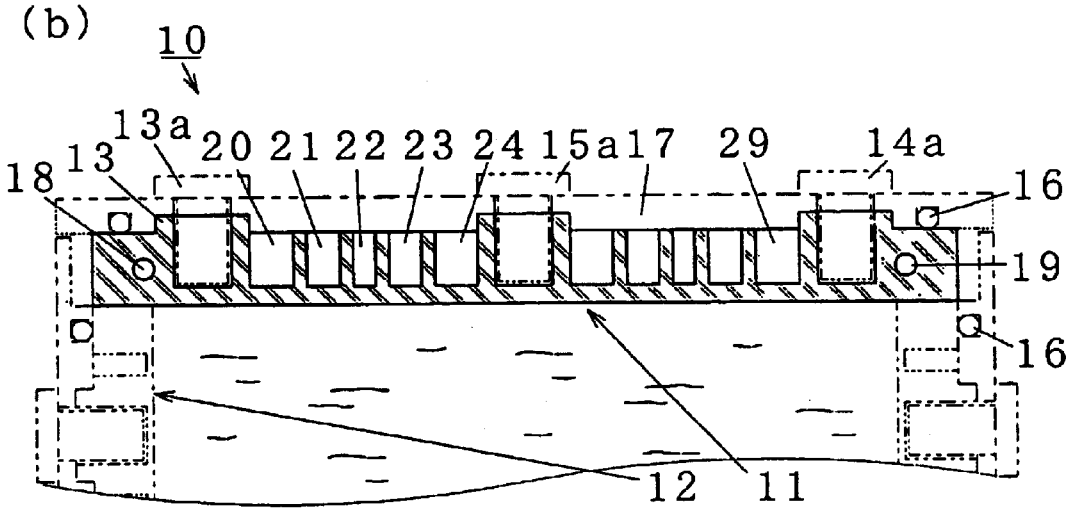

FIG. 1(*a*) is a front elevational view, which is observed from the slit groove side, showing a cooling plate of a build-up mold for continuous casting according to the embodiment, and FIG. 1(*b*) is a cross-section of the same cooling plate.

In FIG. 1, 10 denotes a build-up mold for continuous casting according to the embodiment, 11 denotes a cooling plate made of a copper material, which constructs a build-up mold for continuous casting 10 and which is disposed at the long side of the build-up mold, 12 denotes a cooling plate made of a copper material, which is disposed at the short side of the build-up mold, 13 and 14 denote tightening members that are, respectively, formed at the back side at the left and right end sides of the cooling plate 11, 15 denotes a tightening member that is provided at the back side of the middle portion of the cooling plate 11, 13*a* through 15*a* are boss portions each having a tapped hole, wherein the tightening members formed at the cooling plate 11 are inserted into and connected to, 16 denotes a sealing portion such as an O-Ring that surrounds the upper and lower, and left and right sides of the cooling plate 11, 17 denotes a cooling plate supporting panel that supports the back side of the cooling plate 11, 18 and 19 denote cooling holes that cool down the corner portions, each of which is vertically provided at the left and right end side portions of the cooling plate 11, and 20 through 29 denote ten slit grooves, each of which is formed in the upper and lower direction, that is, the casting direction at the back side of the cooling plate 11.

Furthermore, the build-up mold for continuous casting 10 is constructed by making a pair of two types (long and short) of the cooling plates 11 and 12 orthogonal to each other and assembling them like a box as shown in FIG. 1(*b*). Molten metal such as molten steel is fed through an opening at the upper part of the box-shaped mold, and the molten metal is cooled down from the periphery thereof via the cooling plates. Subsequently, solidified molded pieces are taken out from the lower part of the box-shaped mold.

The cooling plate 11 is made of a copper plate that is approx. 240 mm wide, 900 mm high and 20 through 30 mm thick, wherein the copper plate is processed by a milling machine to create slit grooves 20 through 29 that have an appointed depth.

The cooling plate supporting panel 17 is made of a metallic material such as stainless steel or steel, which is excellent in mechanical strength, and the opening side of the slit grooves of the cooling plates 11 and 12 are sealed to form flow passes of cooling water, and simultaneously is reinforced and fixed at a build-up mold for continuous casting 10, which is to be built up, by means of bolts and nuts.

Figure 2:
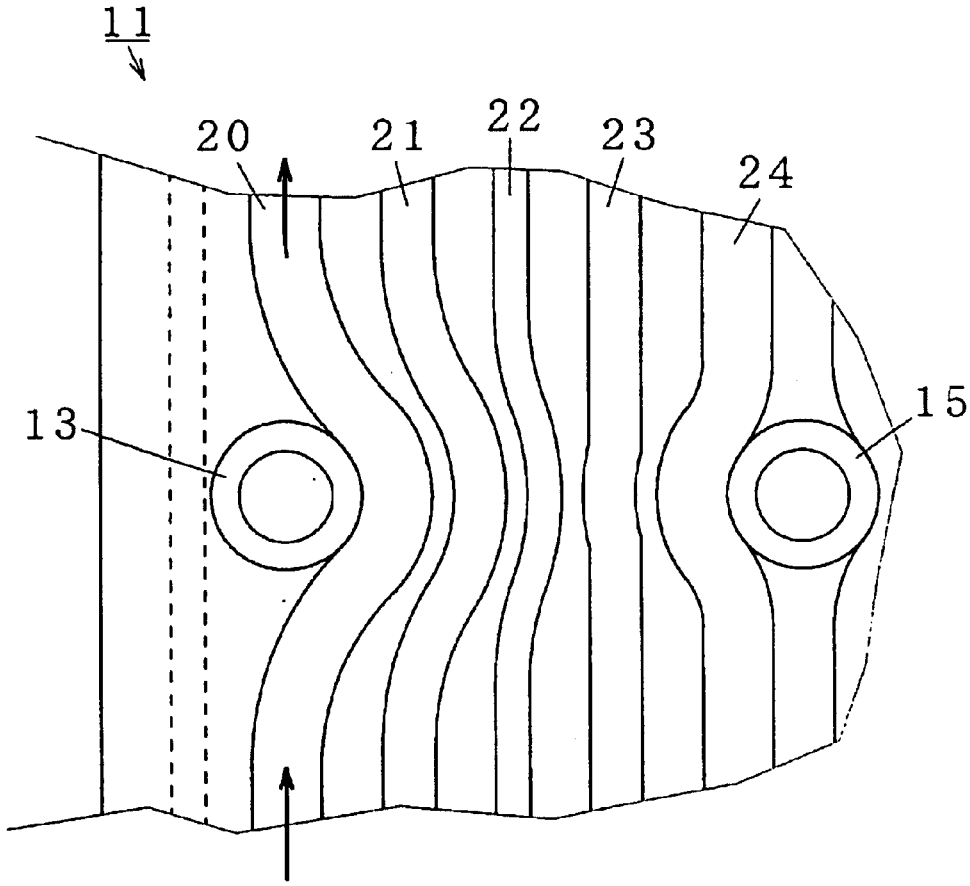
FIG. 2(*a*) is a detailed front elevational view showing arrangement of slit grooves in the vicinity of tightening members in the cooling plate.
Figure 2:
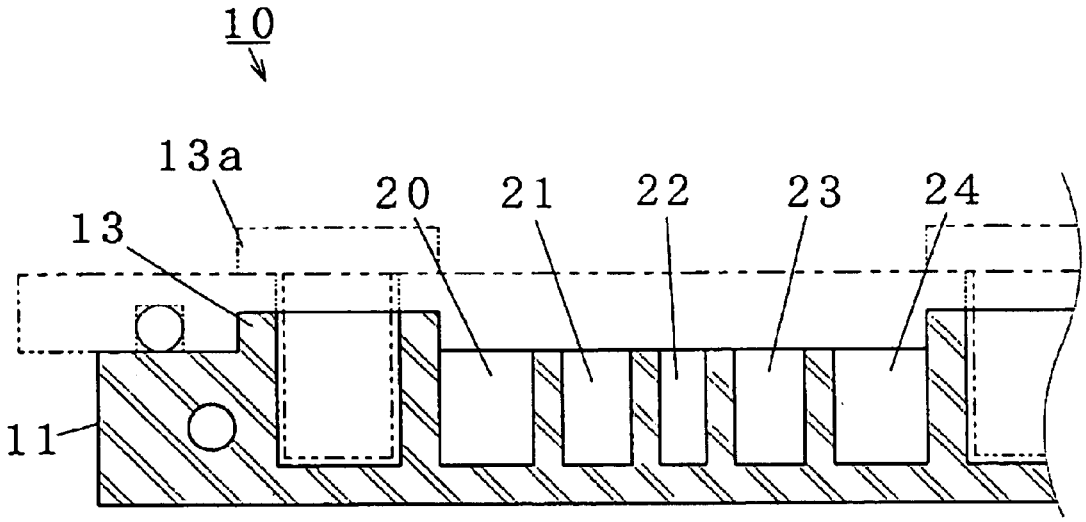

FIG. 2(*a*) is a detailed front elevational view showing the arrangement of slit grooves 20 through 24 in the vicinity of the tightening members 13 and 15 at the cooling plate 11, and FIG. 2(*b*) is the detailed plan view thereof.

As shown in FIG. 1 and FIG. 2, the slit grooves 20 through 29 are formed so as to have an appointed curvature in the casting direction of the build-up mold for continuous casting 10. Cooling water is fed through supply ports (not illustrated) of cooling water, which correspond to the lower end portions of the slit grooves 20 through 29 secured at the lower portion of the cooling plate supporting panel 17, and heated cooling water is discharged through discharge ports corresponding to the upper end portions of the slit grooves 20 through 29.

Respective lateral widths of the slit grooves 20 through 29 on the rectangular section and the curvature disposed in the slalom type are set so as to make the cooling of the entire cooling plate 11 uniform in response to the respective amount of flowing water and cooling characteristics around the tightening members.

Also, since the slit grooves 20 through 24 that are disposed at the left half side of the cooling plate 11 and slit grooves 25 through 29 that are disposed at the right half side are disposed with symmetry, so that the tightening members 13 through 15 have mechanical strength, the slit grooves are formed with a pattern that will become almost symmetrical at the left and right sides regarding as an axis of symmetry the centerline of the cooling plate 11.

The lateral widths of the slit grooves 20 through 24 according to the present embodiment are formed to be 12 mm, 9 mm, 6 mm, 9 mm and 12 mm, respectively. Also, the depth of the slit grooves 20 through 29, that is, the height of the rectangular section, is fixed in a range from almost 9.3 mm through 10.3 mm, wherein the milling process is facilitated.

Thus, in the slalom type slit grooves, by forming the widths of the slit grooves having a large curvature wider than that of the slit grooves having a small curvature, the resistances of flow passes of cooling water flowing into the slit grooves are made even, wherein it becomes possible to uniformly cool the surroundings of the tightening members, which tend to be short of a cooling effect, and places between the tightening members, which will have a large cooling effect.

Further, it becomes possible to set the widths of the respective slit grooves so that the velocity and/or pressure loss of cooling water, which is fed into the respective slit grooves of the cooling plates at an appointed pressure level, can be made roughly equivalent.

Figure 3:
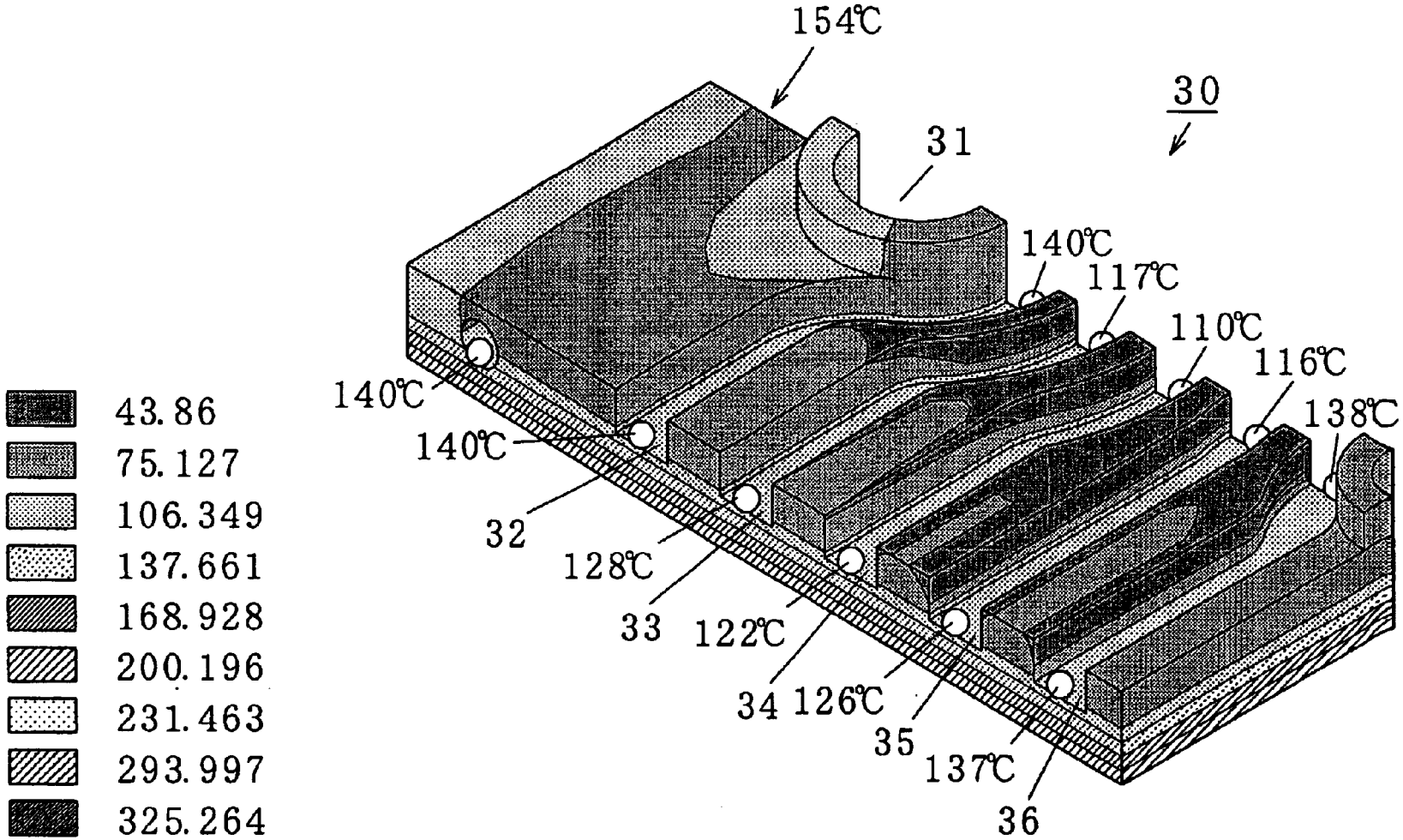
FIG. 3 is a perspective view showing one example of model experiment.
Figure 4:
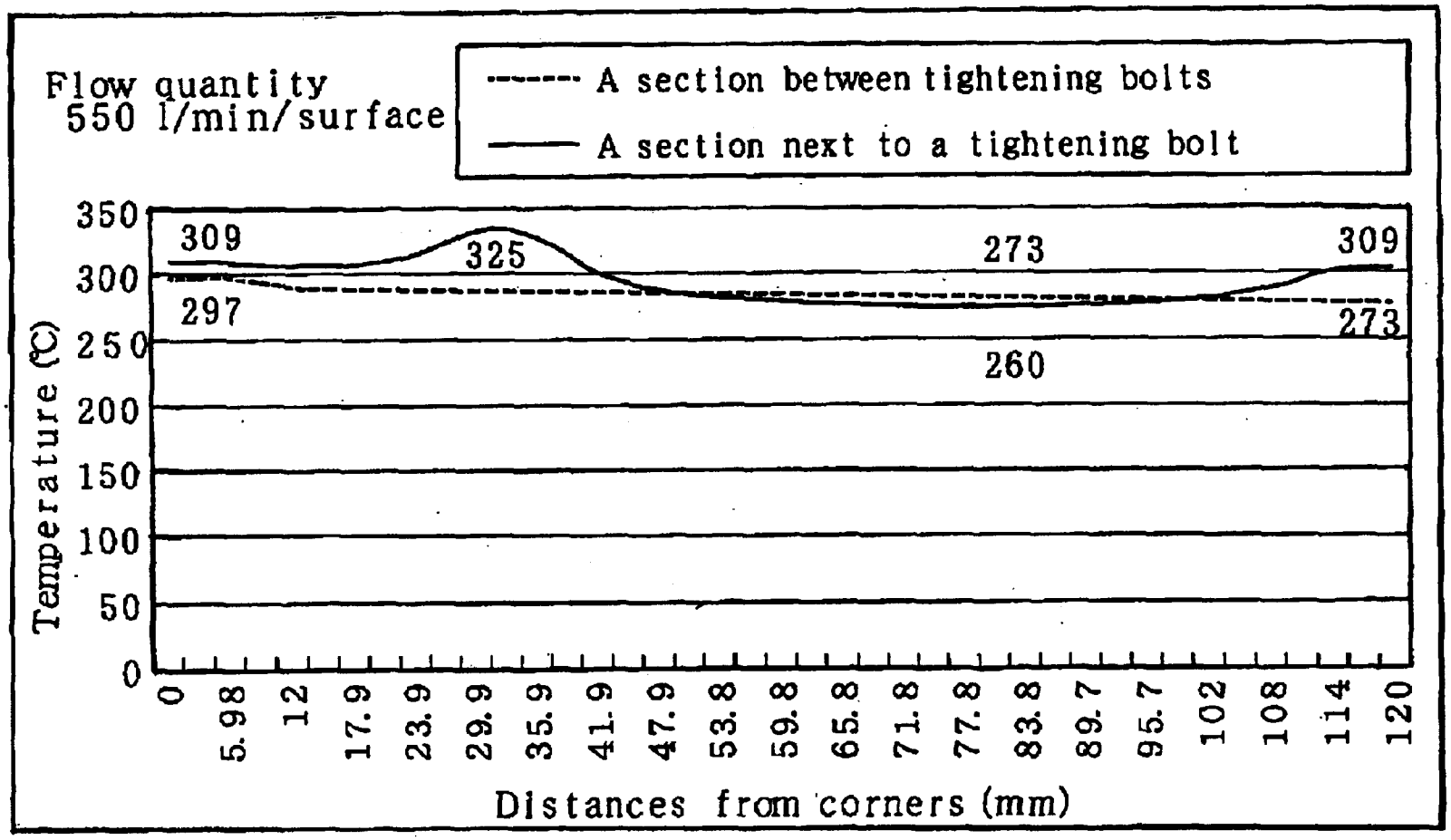
FIG. 4 is a graph showing the results of measurement of a temperature distribution in the cross-sectional direction of the cooling plate.
Figure 5:
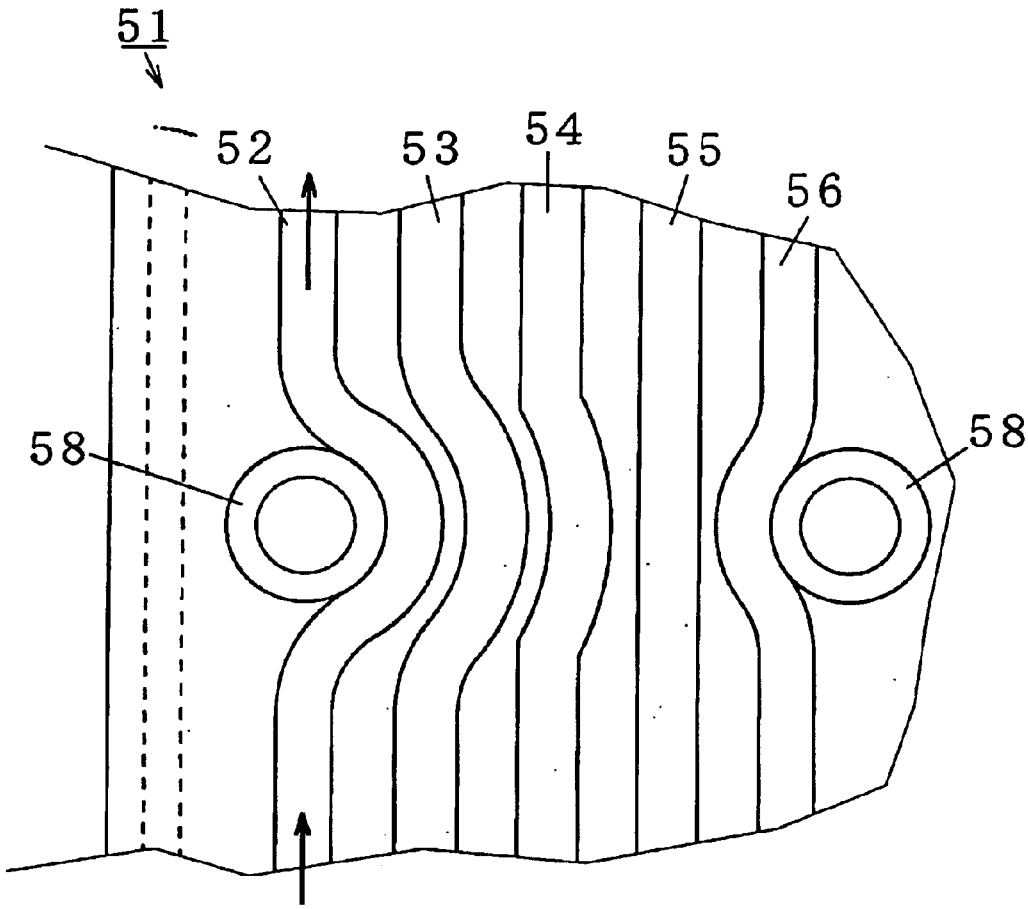
Fig. 5 PRIOR ART
FIG. 5 is an explanatory view showing an example of a build-up mold for continuous casting according to a prior art.
Figure 5:
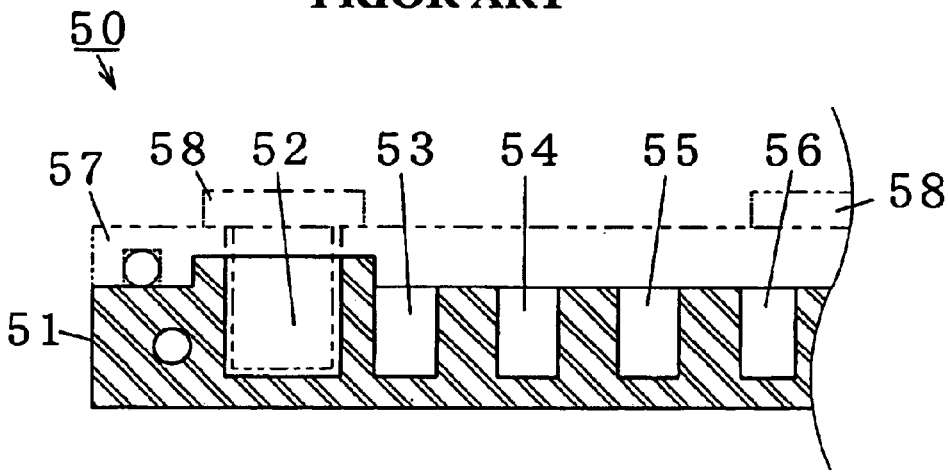
Fig. 5 PRIOR ART

FIG. 3 is a perspective view showing one example of model experiments that have been carried out in order to optimally establish, in compliance with the cooling conditions, the arrangement patterns and lateral widths of the slit grooves around the tightening members that especially tend to become short of cooling, and FIG. 4 is a graph showing the results of temperature measurement with respect to a temperature distribution in the cross-sectional direction of the cooling plate.

In FIG. 3, 30 denotes a cooling plate model, 31 denotes a fitting hole of a bolt, etc., which will become a tightening member, and 32 through 36 denote slalom type slit grooves each set at an appointed width.

Table 1 shows the slit width, slit depth, velocity of cooling water, and thermal transmission coefficient of the slalom type slit grooves 32 through 36 in FIG. 3. Also, FIG. 4 shows a graph of a temperature distribution of the cooling plate under these conditions.

TABLE 1

Thermal analysis in consideration of pressure loss at the short side (A-1 Original (Meniscus)

| Slit No. (From corners) | Slit width mm | Slit depth mm | Velocity m/sec. | Thermal transmission coefficient KJ/m2/hr/° C. |
|---|---|---|---|---|
| Hole | 8 | | 10.47 | 129000 |
| 1 | 9 | 10.3 | 6.75 | 88200 |
| 2 | 10 | 9.3 | 7.73 | 98200 |
| 3 | 10 | 9.3 | 8.97 | 110300 |
| 4 | 10 | 9.3 | 11 | 129000 |

TABLE 1-continued

| Thermal analysis in consideration of pressure loss at the short side (A-1 Original (Meniscus) | | | | |
|---|---|---|---|---|
| Slit No. (From corners) | Slit width mm | Slit depth mm | Velocity m/sec. | Thermal transmission coefficient KJ/m2/hr/° C. |
| 5 | 9 | 10.3 | 7.89 | 99900 |

Also, in the model experiment, conditions necessary to cause water to adequately flow into the respective slit grooves are taken into consideration, and pressure loss of the cooling water flowing into each slalom type slit groove that strengthens the cooling around the bosses of the fitting hole 31 are calculated, and are reflected into the thermal analysis by using the velocity of the respective slit grooves 32 through 36.

Figures in FIG. 3 show values of measured temperatures. Also, it is assumed in the experiment that the thickness of a copper plate is 20.3 mm, the remaining thickness of the slits is 10 mm, the remaining thickness of the holes is 10 mm, the casting speed of molten metal is 2.1 m/min., quantity of cooling water caused to flow in the respective slit grooves 32 through 36 of the cooling plate is 0.55 liters per minute, and pressure loss is approx. $1.96\times10^5$ pascal (Water head pressure: Approx. 20 m).

As shown in FIG. 4 in which the results of the thermal analysis are shown, the temperature distribution of the bolt sections that become tightening members is compared with the temperature distribution in the section between the bolts, wherein it is possible to select conditions in which a difference in temperature between those is reduced.

Thus, by setting the conditions variously, for example, it is possible to acquire detailed conditions in order to make the velocity of the respective slit grooves 32 through 36 fixed, and to make the cooling efficiency of the entire cooling plate uniform.

Since the build-up mold for continuous casting 10 according to the embodiment is constructed as described above, the following actions can be brought about.

(1) A cooling structure can be obtained, in which slalom type slit grooves surrounded around the boss portions are used in order to efficiently cool the surroundings of the boss portions having a tapped hole for tightening a copper plate, where a shortage or cooling is caused to be present, the widths of the slit grooves are widened at portions where the cooling should be strengthened, the water flowing resistances of the cooling water at the portions are reduced, and the velocity of the cooling water is prevented from being slowed down.

(2) Cumbersome positioning operations can be simplified when cutting or machining the slit grooves in a copper plate that becomes a cooling plate, wherein it is possible to reduce the production costs.

(3) By making uniform the cooling efficiency over the entirety of the cooling plate by adjusting the pressure loss and flow quantity of cooling water streaming in respective slit grooves, the thermal expansion can be made uniform to prevent strains of the cooling plate from occurring. And, break-out and defects of molded pieces in the continuous casting of molten metal can be prevented from occurring, wherein the yield of the molded pieces can be improved.

What is claimed is:

1. A build-up mold for continuous casting comprising:

a cooling plate having a back surface with a plurality of slit grooves for passing a cooling fluid, each one of said plurality of slit grooves having a depth and a width;

a supporting panel configured to cover said plurality of slit grooves so as to form a plurality of cooling channels; and at least one tightening member for attaching said supporting panel to said back surface, wherein each one of said cooling channels is separate, distinct, and unconnected from, and has substantially the same depth as, the other cooling channels, and said width varies based on a localized cooling requirement for said tightening member.

2. The build-up mold for continuous casting as set forth in claim 1, wherein a ratio of a maximum value of said width to a minimum value thereof is between 1.1 and 4.

3. The build-up mold for continuous casting as set forth in claim 1 or 2, wherein a pattern of said plurality of slit grooves is roughly symmetrical with respect to a centerline of said cooling plate.

4. The build-up mold for continuous casting as set forth in any one of claims 1 or 2, wherein each one of said plurality of slit grooves is disposed at said cooling plate in a wave pattern so as to have a plurality of portions having a curvature, wherein the width of a slit groove having a large curvature is larger than the width of a slit groove having a small curvature.

5. The build-up mold for continuous casting as set forth in any one of claims 1 or 2, wherein a velocity and/or a pressure drop of said cooling fluid in one of said cooling channels is substantially the same as the velocity and/or the pressure drop in the other cooling channels for a given overall velocity or a given overall pressure drop in said build-up mold.

6. A build-up mold for continuous casting comprising:

a cooling plate having a back surface with a plurality of slit grooves for passing a cooling fluid, each one of said plurality of slit grooves having a depth and a width;

a supporting panel configured to cover said plurality of slit grooves so as to form a plurality of cooling channels;

at least one tightening member for attaching said supporting panel to said back surface, wherein each one of said cooling channels is distinct and unconnected from, and formed separately and the depths of said cooling channels are formed to be substantially equivalent to each other, and the widths of said slit grooves disposed so as to bypass in the vicinity of said tightening members are formed to be larger than the widths of the slit grooves disposed in a zone having high cooling efficiency between said tightening members; and wherein a radius of curvature of each one of said cooling channels is not equal to the radius of curvature of said tightening members.

7. The build-up mold for continuous casting as set forth in claim 6, wherein a ratio of a maximum value of said width to a minimum value thereof is between 1.1 and 4.

8. The build-up mold for continuous casting as set forth in claim 6, wherein a pattern of said plurality of slit grooves is roughly symmetrical with respect to a centerline of said cooling plate.

9. The build-up mold for continuous casting according to claim 6, wherein at least one of a velocity and a pressure drop of said cooling fluid in each one of said cooling channels is formed so as to be a given overall velocity or a given overall pressure drop.

10. A build-up mold for continuous casting comprising:

a cooling plate having a back surface with a plurality of slit grooves for passing a cooling fluid, each one of said plurality of slit grooves having a depth and a width;

a supporting panel configured to cover said plurality of slit grooves so as to form a plurality of cooling channels;

at least one tightening member for attaching said supporting panel to said back surface, wherein each one of said cooling channels is distinct and unconnected from and formed separately, and the depths of said cooling channels are formed to be substantially equivalent to each other and the widths of said slit grooves disposed so as to bypass in the vicinity of said tightening members are formed to be larger than the widths of the slit grooves disposed in a zone having high cooling efficiency between said tightening members; and wherein said slit grooves disposed on said cooling plate are of a slalom type that is formed so as to have a plurality of portions having a given curvature, and the widths of slit grooves having a large curvature is formed to be larger than the widths of slit grooves having a small curvature.

11. The build-up mold for continuous casting as set forth in claim 10, wherein a ratio of a maximum value to said width to a minimum value thereof is between 1.1 and 4.

12. The build-up mold for continuous casting as set forth in claim 10, wherein a pattern of said plurality of slit grooves is roughly symmetrical with respect to a centerline of said cooling plate.

13. The build-up mold for continuous casting as set forth in claim 10, wherein a velocity and/or a pressure drop of said cooling fluid in each one of said cooling channels is formed so as to be a given overall velocity or a given overall pressure drop.

* * * * *